US007446259B2

(12) United States Patent
Yi et al.

(10) Patent No.: US 7,446,259 B2
(45) Date of Patent: Nov. 4, 2008

(54) APPARATUS AND METHOD FOR PREVENTION OF INCORRECT INSERTION OF CABLE BUNDLE

(75) Inventors: George Youzhi Yi, Fremont, CA (US); William Lewis, Mountain View, CA (US)

(73) Assignee: Cisco Technology, Inc., San Jose, CA (US)

( * ) Notice: Subject to any disclaimer, the term of this patent is extended or adjusted under 35 U.S.C. 154(b) by 574 days.

(21) Appl. No.: 10/944,598

(22) Filed: Sep. 16, 2004

(65) Prior Publication Data

US 2006/0057898 A1 Mar. 16, 2006

(51) Int. Cl.
*H01B 11/04* (2006.01)

(52) U.S. Cl. ..... 174/113 R

(58) Field of Classification Search ..... 174/111, 174/113 R, 117 F; 439/719
See application file for complete search history.

(56) References Cited

U.S. PATENT DOCUMENTS

| | | | | |
|---|---|---|---|---|
| 4,268,986 | A | 5/1981 | Piana | |
| 6,374,126 | B1 * | 4/2002 | MacDonald et al. | 455/569.1 |
| 6,538,205 | B2 * | 3/2003 | Ueno | 174/117 F |
| 6,763,623 | B2 | 7/2004 | Piana | |
| 6,909,050 | B1 * | 6/2005 | Bradford | 174/110 R |
| 2003/0092313 | A1 * | 5/2003 | Schlueter et al. | 439/540.1 |
| 2005/0016617 | A1 * | 1/2005 | Spain | 140/123 |

* cited by examiner

*Primary Examiner*—Chau N Nguyen
(74) *Attorney, Agent, or Firm*—Brian N. Young; Trellis IP Law Group

(57) ABSTRACT

An apparatus and method for preventing incorrect insertion of individual plugs into multiple connector ports is provided. A cable bundle is provided for the purpose. The cable bundle includes a plurality of cables and at least one slider. The slider holds the plurality of cables within the cable bundle in a required sequence. The slider can be positioned along the length of the cable bundle to determine the distance between the ends of the cables. This adjusted length and the sequence in which the plurality of cables are held, prevents incorrect insertion of individual cables into connector ports. The cable bundle may include a guide.

14 Claims, 7 Drawing Sheets

APPARATUS AND METHOD FOR PREVENTION OF INCORRECT INSERTION OF CABLE BUNDLE

BACKGROUND OF THE INVENTION

1. Field of Invention

The present invention relates in general to cables, such as a module having attached cables for inserting into and connecting with multiple connector ports of a device. More specifically, embodiments of the present invention relate to systems and methods for preventing the incorrect insertion into connector ports of plugs attached to Ethernet cable bundles.

2. Description of the Background Art

A system may include a plurality of devices that may be connected together. These connections may be made with the help of cables. For example, in control systems, various devices such as actuators, controllers and display units are connected to a control panel. These connections may require many cables to be plugged into the numerous connector ports. Incorrect connections, i.e., one or more of the individual cables being inserted into incorrect connector ports causes the system to malfunction or not function at all.

Another example of a system, including a plurality of devices that may be connected with the help of cables, is an Ethernet network. Devices used over the Ethernet may include a number of switches and routers to facilitate traffic over the Ethernet. Some switches and routers may be equipped with Power-Over-Ethernet (POE) capability. POE or 'Active Ethernet' eliminates the need to separately carry power to wireless access points or devices that are wired to it, for example, a LAN. With the use of the POE, a single cable, such as a CAT5 (Category-5, according to International Standards Organization standards) Ethernet cable, can be used to carry both power and data to each device and access point.

The switches, routers, and POE capable devices (POE devices) have multiple Ethernet connector ports. A POE device is connected with switches and routers through these multiple connector ports by Ethernet cables. It is desired that these Ethernet connections are not swapped. This is because swapping may cause improper functioning of a POE device.

The incorrect insertion of cables into connector ports can be avoided by using integrated plugs. However, this may not be convenient as connector ports, such as multiple Ethernet connector ports, are often built in the form factors of 1×4, 1×8, 2×4, 2×8, etc. Hence, high tolerance restrictions are required for the integrated plug to connect with connector ports. Further, multiple connector ports often have different dimensions even for the same form factor design. This makes the use of an integrated plug even more difficult.

Alternatively, to help avoid swapping or incorrect connections, the cables are numbered or tagged. For example, Ethernet cable numbered 'i' is to be inserted into Ethernet connector port 'i' on the switch or router. However, there is no mechanism to prevent inadvertent swapping of the cables with respect to connector ports when a user connects the cables to the connector ports.

SUMMARY OF EMBODIMENTS OF THE INVENTION

Embodiments of the present invention provide a cable bundle. The cable bundle includes a plurality of cables and at least one slider. The slider prevents incorrect insertion of individual cables into the connector ports of a system.

Embodiments of the present invention provide a method for preventing the insertion of plugs into incorrect connector ports. The method is executed by providing a plurality of cables terminating in plugs and engaged by a slider in a required and/or desired sequence. This is followed by positioning, such as by sliding, the slider along the length of the cables to adjust operational length of the cables and the distance between individual plugs. Operational length is the length of a cable from the tip of a plug connected to it to the point at which the slider meets the cable. Thereafter, the plugs are inserted into the connector ports.

Embodiments of the invention further provide a module assembly comprising a module, a plurality of cables coupled to the module, a guide engaged to the cables, and a slider slidably engaged to the cables. The cables generally flange outwardly from the guide toward the slider. The module assembly may additionally comprise a device coupled to the cables. The device may comprise a router or switch having a plurality of ports. The cables may comprise Ethernet cables having overmolds bound to plugs. The plugs slidably lodge in the ports of the router or switch.

Embodiments of the invention still further proved a method for preventing the insertion of plugs into incorrect connector ports of a device. The method comprises providing a plurality of Ethernet cables passing through a guide and passing through a slider in accordance with a required sequence, and positioning the slider along the length of the Ethernet cables to adjust operational length of the Ethernet cables and the distance between individual plugs that are attached to the Ethernet cables. The operational length comprises a length of an Ethernet cable from the tip of a plug connected to it to the point at which slider meets that Ethernet cable. The method further comprises inserting the plugs into connector ports of a device.

These provisions together with the various ancillary provisions and features which will become apparent to those artisans possessing skill in the art as the following description proceeds are attained by devices, assemblies, systems and methods of embodiments of the present invention, various embodiments thereof being shown with reference to the accompanying drawings, by way of example only, wherein:

DETAILED DESCRIPTION OF EMBODIMENTS OF THE INVENTION

In the description herein for embodiments of the present invention, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Devices within a system may be connected with the help of cables. Proper functioning of the connected device and system may depend on the connections being made correctly. For example, in an Ethernet system, various devices may be plugged into the system using required connector ports through cables. The plugs need to be connected to the correct connector port for the proper functioning of the Ethernet. There may be errors in connections when a user connects the cables, especially when the cables need to be connected to, for example, routers or switches where multiple connector ports are placed on a face of the device. This inadvertent swapping of plugs results in incorrect connections. The invention, therefore, provides an apparatus and method to prevent the incorrect insertion of individual plugs into such multiple connector ports.

Figure 1:
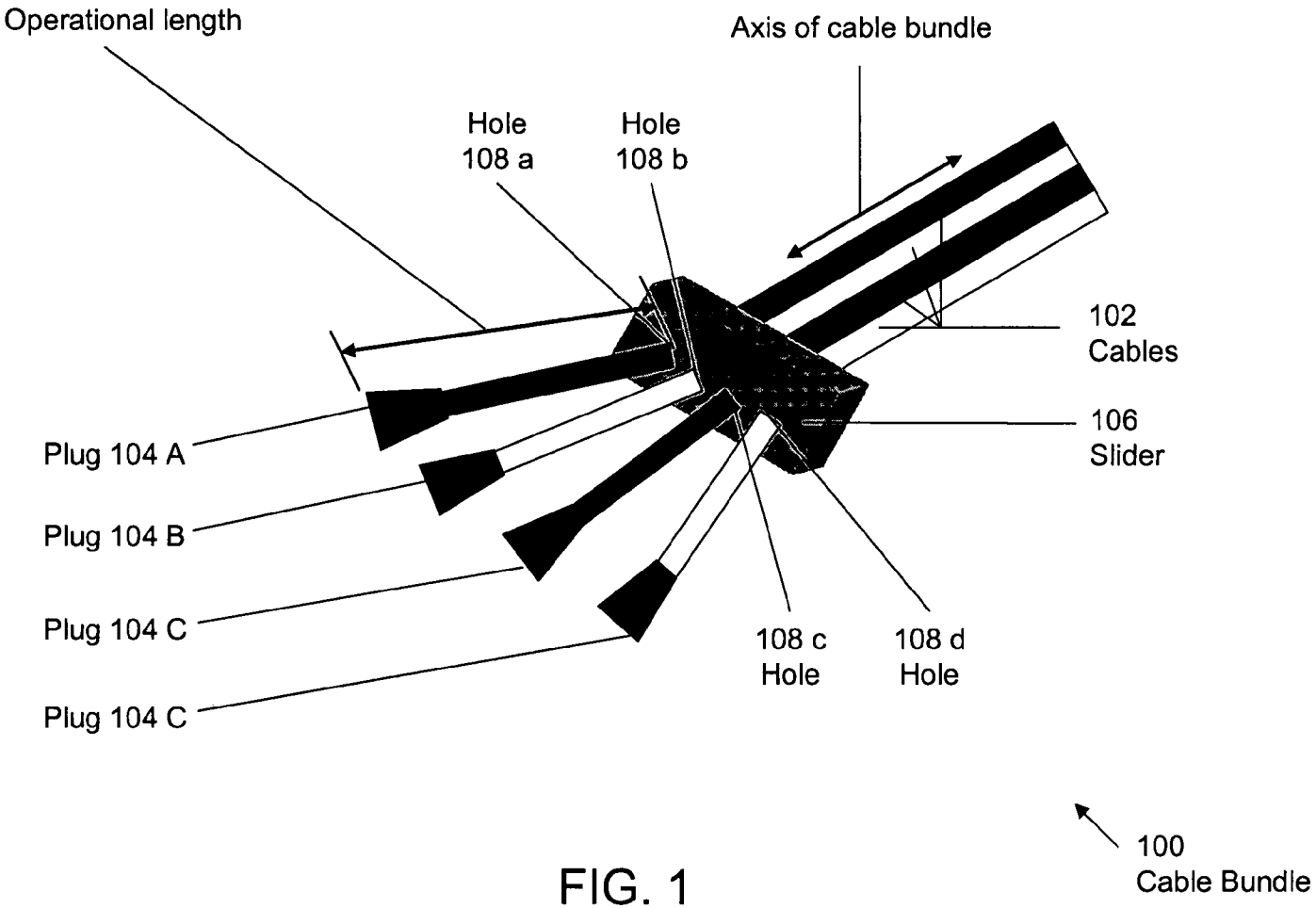
FIG. 1 is a schematic diagram illustrating an exemplary embodiment of the invention.

FIG. 1 illustrates an exemplary embodiment of the invention. A cable bundle 100 is formed of a plurality of cables 102. Cables 102 may be utilized to connect one or more devices to the required multiple connector ports. Cables 102 end in plugs 104. Plugs 104 are inserted into the required multiple connector ports in order to establish the connections. The connections are successful if each plug 104 is plugged into the correct individual connector port.

For the purpose of prevention of incorrect insertion of plugs 104 in the connector ports, a slider 106 is provided in accordance with various embodiments of the invention. Slider 106 has holes 108*a*, 108*b*, 108*c* and 108*d*, as shown, such that cables 102 can pass through holes 108. In accordance with various embodiments of the invention, each hole within slider 106 allows one cable 102 to pass through it. Cables 102 pass through slider 106 and are held in a required sequence by slider 106. In accordance with various embodiments of the invention, this required sequence corresponds to the sequence of the connector ports into which cables 102 are to be inserted.

Slider 106 can be moved along the length of cables 102. This movement of slider 106 is along the axis of cable bundle 100, as shown in FIG. 1. The position of slider 106 along the axis of cable bundle 100 determines the distance between individual plugs 104 at the ends of cables 102. This distance is adjusted based on the distance between the multiple connector ports into which plugs 104 are to be inserted. In accordance to various embodiments of the invention, this distance is either equal to or marginally greater than the distance between the corresponding connector ports.

The distance between individual plugs 104 and the sequence in which they are held by slider 106 is maintained such that the swapping of plugs 104 is prevented. Therefore, slider 106 prevents the incorrect insertion of cables 102.

In addition to the distance between individual plugs 104, the position of slider 106 along the axis of cable bundle 100 determines the operational length of each individual cable 102. The operational length of a cable 102 is the length of cable 102 from the tip of the plug to the point at which slider 106 meets that cable 102. The operational length determines the flexibility of cables 102. Greater the operational length, greater is the flexibility. The flexibility of the cable at the plug end is important for inserting the plugs to the connector ports. Greater the flexibility, easier it is to insert cable 102 into the corresponding connector port.

Figure 2:
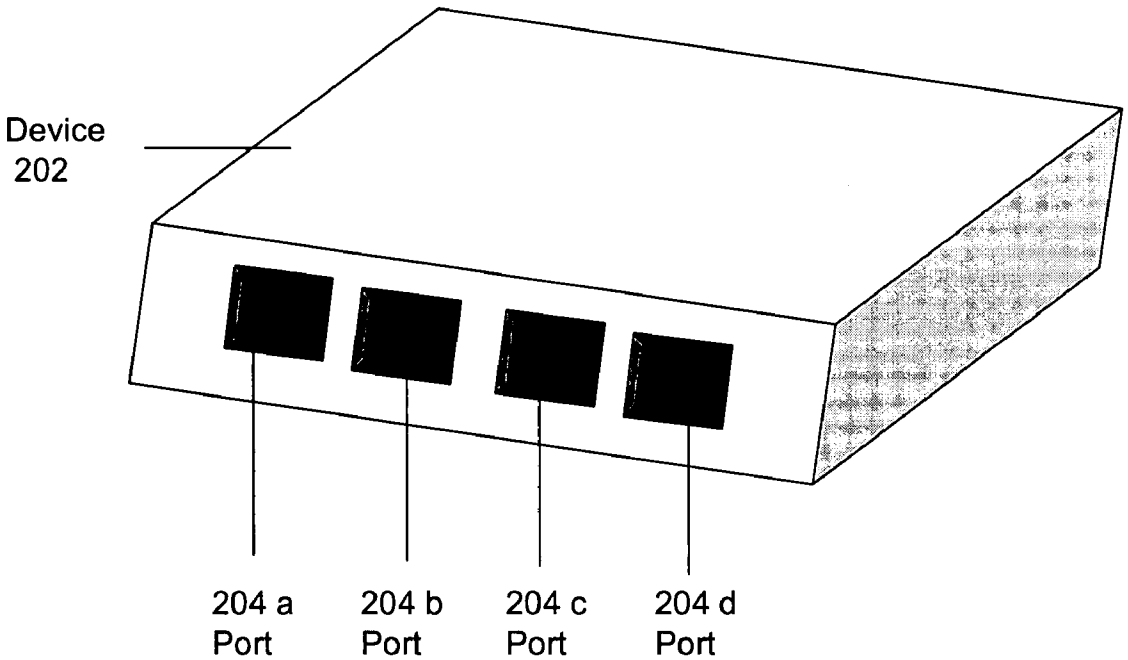
FIG. 2 is a schematic diagram illustrating an exemplary device with multiple connector ports to be connected through cables.

FIG. 2 illustrates an exemplary device with multiple connector ports, to be connected through the cables. A device 202, shown in FIG. 2, is an exemplary device that needs to be connected through its multiple connector ports 204. Cables 102, plugged into multiple connector ports 204, connect device 202 as required. Slider 106 holds cables 102 in the required sequence. Further, slider 102 is positioned such that the distance between individual plugs 104 corresponds to the distance between individual connector ports 204. The method of preventing the incorrect insertion of plugs 104 into connector ports 204 is described in detail with reference to FIG. 3.

Figure 3:
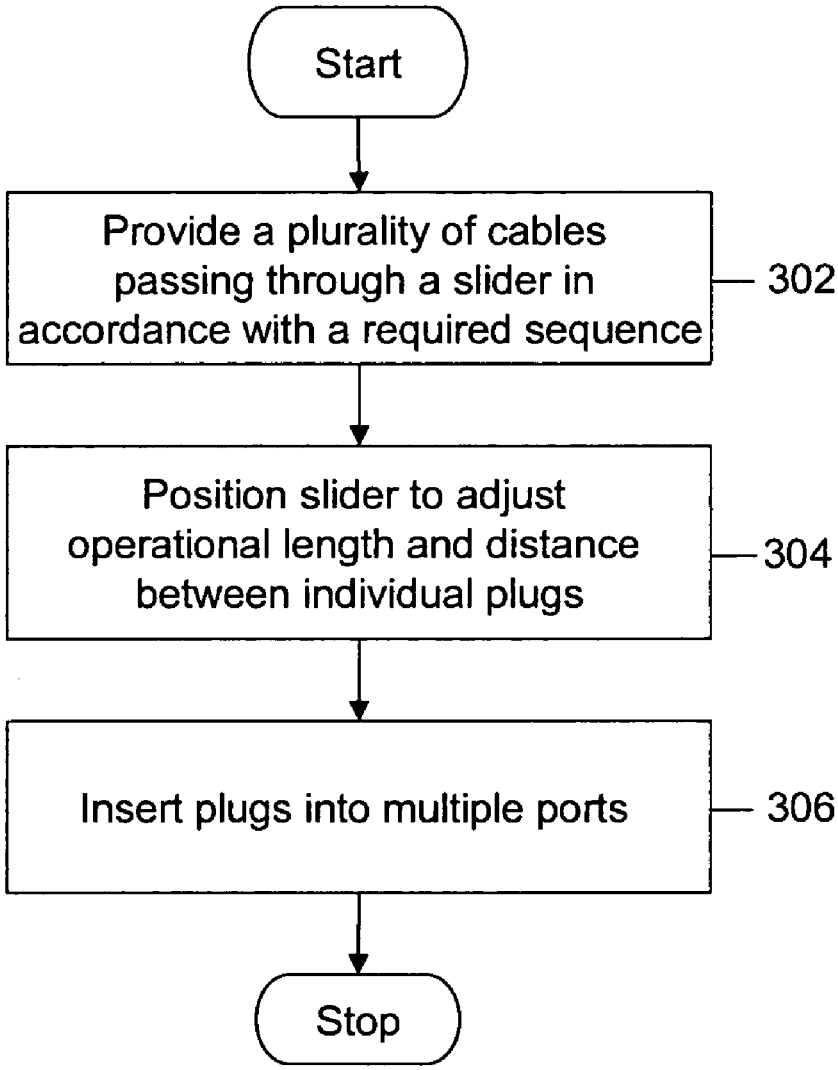
FIG. 3 is a flowchart of an exemplary method for preventing the insertion of plugs into incorrect connector ports, in accordance with various embodiments of the invention.

FIG. 3 is a flowchart of an exemplary method for preventing the insertion of plugs into incorrect connector ports, in accordance with various embodiments of the invention. At step 302, the cables 102 and slider 106 are provided (e.g., produced or manufactured) such that cables 102 pass through the slider 106 in a required sequence. This sequence, as mentioned earlier, is in accordance with the sequence of the connector ports in which the cables 102 are to be inserted. For example, suppose cables 102 are to be inserted into connector ports 204 to connect device 202 to a similar other device. Device 202 has four connector ports 204, referred as 204*a*, 204*b*, 204*c*, and 204*d* and correspondingly plugs 104, referred (with reference to FIG. 1) as 104 A, 104 B, 104 C, and 104 D. Plugs 104 A, 104 B, 104 C, and 104 D are to be inserted respectively into connector ports 204*a*, 204*b*, 204*c*, and 204*d*. Therefore, cables 102 corresponding to plugs 104 pass through the slider 106 in the sequence as shown in FIG. 1.

At step 304, slider 106 is moved along the axis of cable bundle 100 in order to adjust their operational lengths. The operational lengths are adjusted in such a way as to provide sufficient flexibility. In addition, the operational length is adjusted in such a way as to provide proper distance between individual plugs 104. This distance is adjusted based on the distance between individual connector ports 204 of device 202. This distance may be equal to or greater than the distance between individual connector ports 204.

At step 306, individual plugs 104 are inserted into corresponding individual connector ports 204. The sequence in which cables 102 are held and the distance between individual plugs 104 that are maintained by slider 106 prevents the incorrect insertion of individual plugs 104 into connector ports 204.

In accordance with various embodiments of the invention, the above described apparatus and methods are utilized in a system. This system includes multiple connector ports and at least one cable bundle. This cable bundle is used to connect one or more devices to the multiple connector ports. The connection is achieved by inserting plugs, which form the ends of the individual cables, into the multiple connector ports. This cable bundle includes means for preventing the individual plugs from being inserted into incorrect connector ports. In accordance with various embodiments of the invention, the means for preventing individual plugs from being inserted into incorrect connector ports is a slider that can be positioned along the length of the cable bundle. An example of such a system is described further with reference to FIG. 4.

Figure 4:
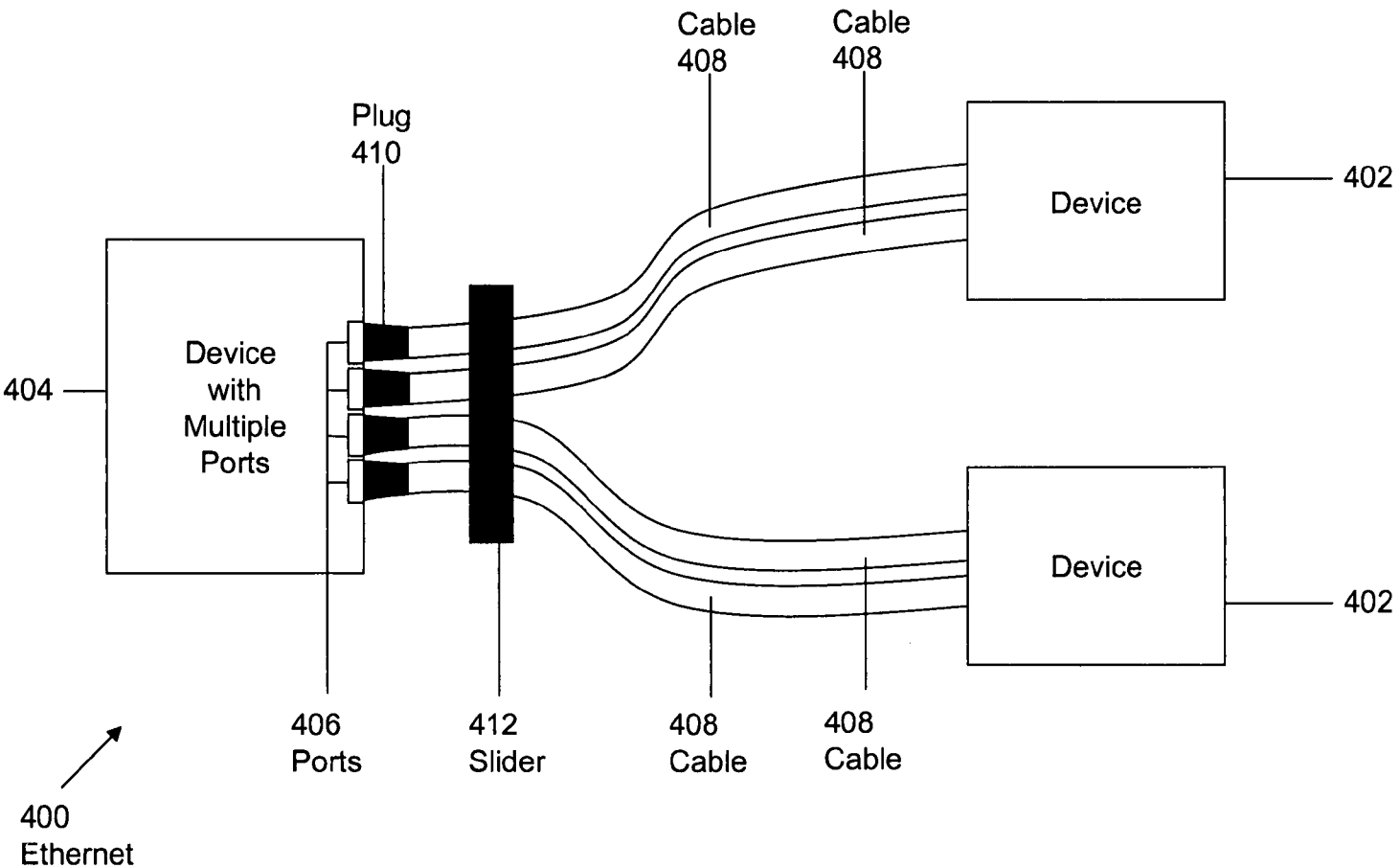
FIG. 4 is a schematic diagram illustrating exemplary devices within an Ethernet, in accordance with various embodiments of the invention.

FIG. 4 illustrates exemplary devices within an Ethernet, in accordance with various embodiments of the invention. One or more devices 402 are to be connected to a device 404. Device 404 has multiple Ethernet connector ports 406 for the connection. For the purpose of connection, a plurality of Ethernet cables 408 are used to connect devices 402 to device 404. Ethernet cables 408 end in Ethernet plugs 410. Ethernet plugs 410 are inserted into multiple Ethernet connector ports 406 to form the connection.

Ethernet cables 408 form the cable bundle held together by a slider 412. Slider 412 holds Ethernet cables 408 in a required sequence that reflects the sequence of multiple Ethernet connector ports 406 into which individual Ethernet plugs 410 are inserted. Slider 412 is positioned such that the distance between individual Ethernet plugs 410 corresponds to the distance between corresponding multiple Ethernet connector ports 406. Slider 412 is also positioned so that the operational length of Ethernet cables 408 is such that it provides sufficient flexibility for easy insertion of Ethernet cables 408.

The sequence in which Ethernet cables 408 are held by slider 412 and the distance between individual Ethernet plugs 410, determined by the position of slider 412, prevents the insertion of individual Ethernet plugs 410 into incorrect multiple Ethernet connector ports 406.

In accordance with various embodiments of the invention, devices 402 and device 404 include a plurality of switches and routers. These switches and routers may further include Power-Over-Ethernet (POE) devices. These POE devices are connected by Ethernet cables 408. Ethernet cables 408 may carry data as well as power to the connected POE devices.

Figure 5:
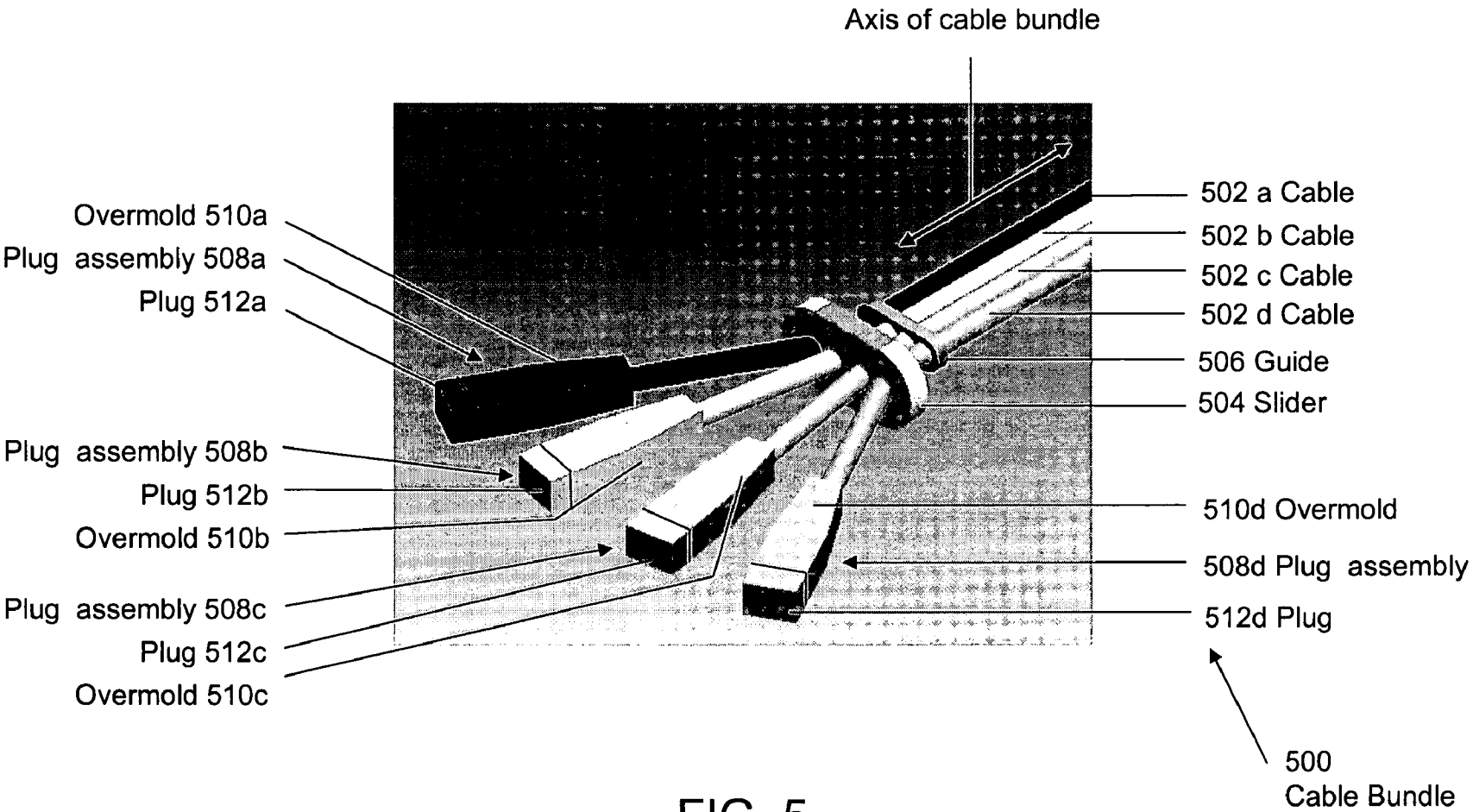
FIG. 5 is a perspective view of an embodiment of the invention, illustrating an Ethernet cable bundle slidably passing through a slider and passing through a guide.

Another embodiment of the invention is described with reference to FIG. 5 to FIG. 7. FIG. 5 is a perspective view illustrating a cable bundle 500, such as an Ethernet cable bundle. Cable bundle 500 comprises cables 502*a*, 502*b*, 502*c* and 502*d*. Cable bundle 500 slidably passes through a slider 504 and passes through a guide 506. The guide 506 may be stationarily affixed (i.e., immovably bound) to the respective cables (i.e., cables 502*a*, 502*b*, 502*c* and 502*d*) or the guide 506 may be slidable along the cables. In a preferred embodiment of the invention, the guide 506 is stationarily affixed to the respective cables. Cables 502*a*, 502*b*, 502*c* and 502*d* flange outwardly from guide 506 toward slider 504. Slider 504 may be slid along respective cables, i.e., cables 502*a*, 502*b*, 502*c* and 502*d*, as required to maintain a cable sequence to facilitate coupling respective cables to a device, such as a router or switch. In an embodiment of the invention, cables 502*a*, 502*b*, 502*c* and 502*d* are Ethernet cables respectively terminating in plug assemblies 508*a*, 508*b*, 508*c* and 508*d*. Plug assemblies 508 include overmolds 510 bound to plugs 512, which insert into any suitable ports. More specifically, plug assemblies 508*a*, 508*b*, 508*c* and 508*d* respectively include the following overmold-plug combinations: an overmold 510*a*-plug 512*a*, an overmold 510*b*-plug 512*b*, an overmold 510*c*-plug 512*c*, and an overmold 510*d*-plug 512*d*. In an embodiment of the invention, slider 504 may be slid toward and away from overmolds 510 as required.

Figure 6:
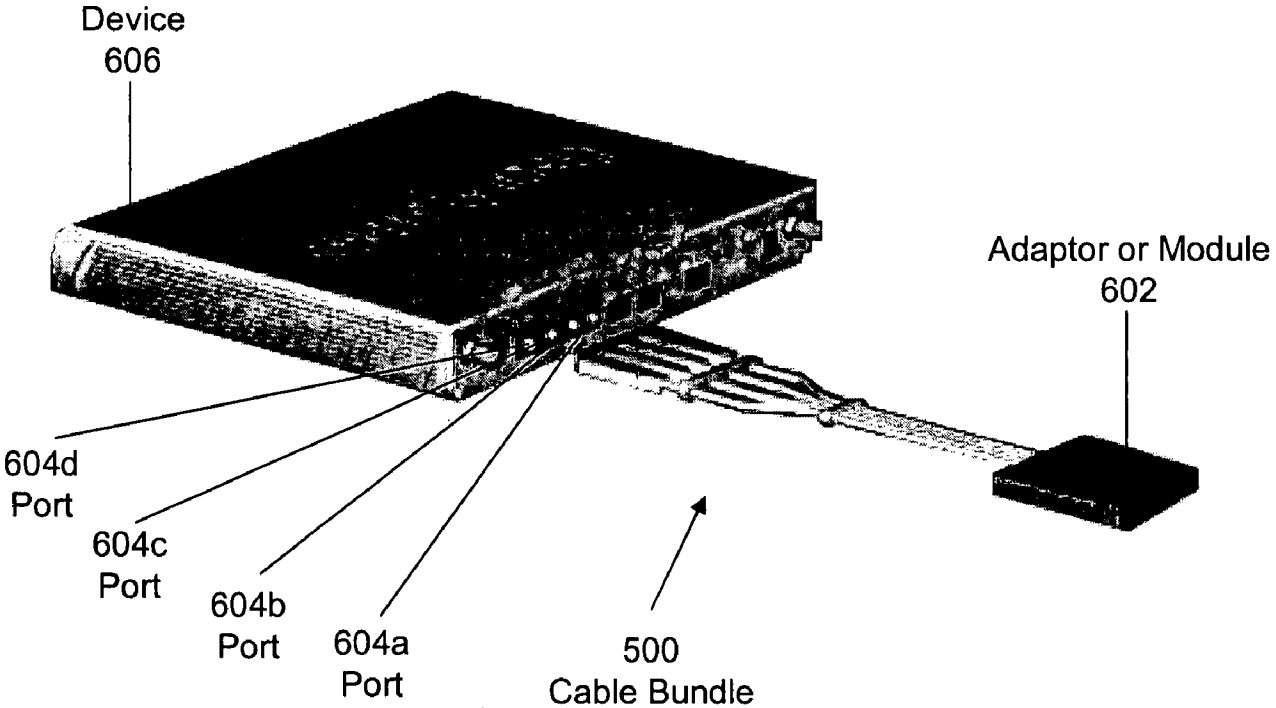
FIG. 6 is a perspective view of the embodiment of the Ethernet cable bundle of FIG. 5 engaged to an adaptor or module and aligned for coupling to ports of a device.

FIG. 6 is a perspective view of the embodiment of Ethernet cable bundle 500 engaged to an adaptor or module 602, such as a POE module, and aligned for coupling to ports 604*a*, 604*b*, 604*c*, and 604*d* of a device 606, such as a router or switch.

Figure 7:
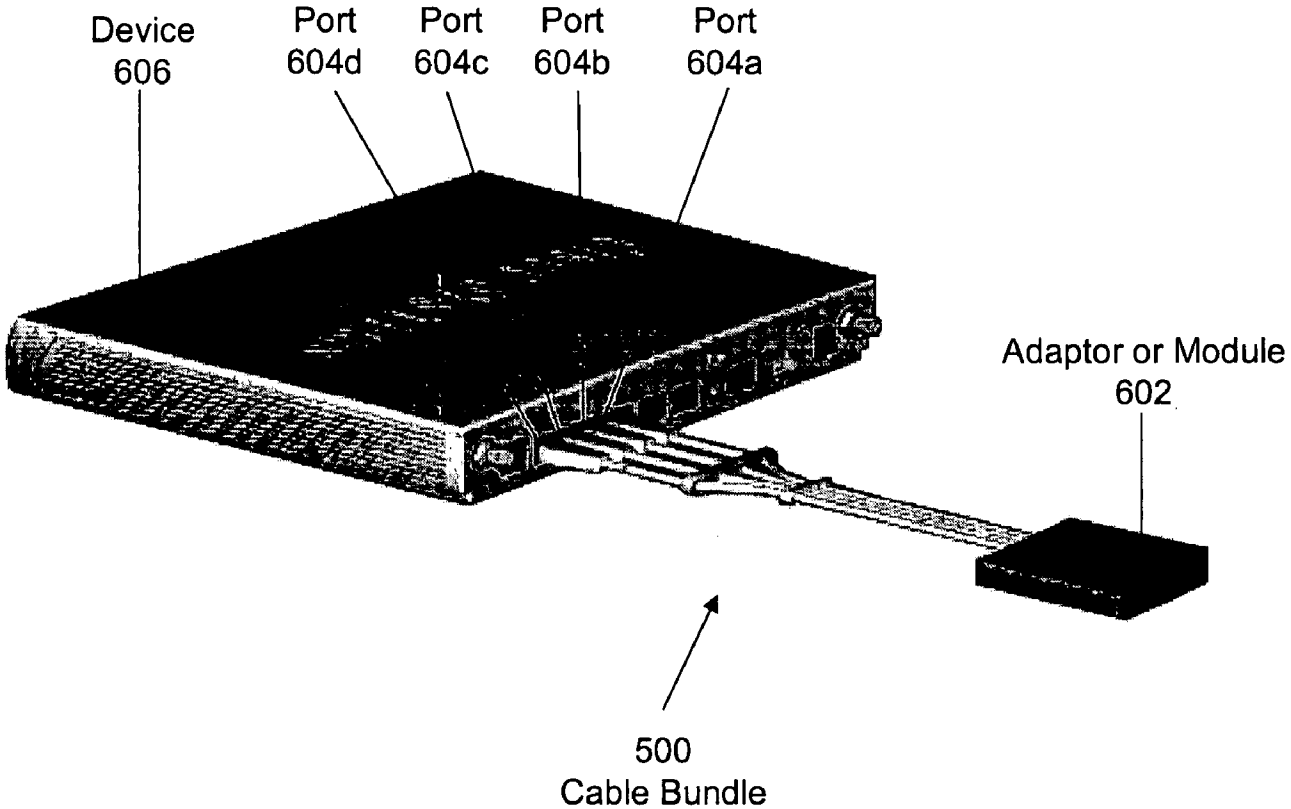
FIG. 7 is a perspective view of the embodiment of the Ethernet cable bundle of FIG. 5 engaged to an adaptor or module (e.g., a POE module) and coupled to ports of a device (e.g., a router or switch).

FIG. 7 is a perspective view of the embodiment of cable bundle 500 engaged to adaptor or module 602, such as a POE module and coupled to ports 604*a*, 604*b*, 604*c*, and 604*d* of device 606, such as a router or switch. In an embodiment of the invention where cables 502*a*, 502*b*, 502*c* and 502*d* are Ethernet cables, plugs 512*a*, 512*b*, 512*c*, and 512*d* of plug assemblies 508*a*, 508*b*, 508*c* and 508*d* are removably lodged in ports 604*a*, 604*b*, 604*c*, and 604*d* of device 606.

The various embodiments of the invention provide an easy and inexpensive mechanism to prevent cables from being inserted into incorrect connector ports when a user plugs in numerous cables.

The various embodiments of the invention provide a tolerance-free design. For example, multiple Ethernet connector ports are built in 1×2, 1×4, 1×6, 1×8, 1×12, 2×2, 2×4, 2×6, 2×8, and 2×12 form factors. Further, multiple connector ports often have different dimensions even for the same form factor design. The cable bundle design provided by various embodiments of the invention does not require any special tolerance for the connections and can connect with any multiple connector port design. Hence, the form factor and the dimensions of the ports do not affect the efficacy of the apparatus provided by various embodiments of the invention.

The various embodiments of the invention further facilitate grouping of cables into cable bundles, thereby making connecting of cables more manageable. Further, this keeps the cable wiring clean.

In addition, the various embodiments of the invention allow maintenance of the flexibility of cables, as required for connections. This facilitates the easy connection of plugs with connector ports, as though a single loose cable is being connected.

The various embodiments of the invention facilitate adjusting the operational length of cables by moving slider, thereby providing easy access to the plugs and multiple connector ports.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any directional arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. A cable bundle, comprising a plurality of non-integrated cables configured to carry data for a networking device, each cable configured with a separate plug to be inserted into a port of the networking device; and at least one slider comprising three or more apertures spaced apart certain distances from each other, each aperture configured to hold one of the non-integrated cables, wherein the at least one slider is slidably engaged with the three or more non-integrated cables and movable to a position where the three or more apertures being spaced apart the certain distances from each other allow the plugs for the cables to correspond to distances between the ports such that an operational length of the cables from the at least one slider to each plug maintains the cables in a cable sequence for inserting the plugs for the cables into the ports such that incorrect insertion of plugs into the ports is prevented upon insertion of one of the plugs into one of the ports to prevent incorrect functioning of the networking device due to incorrect insertion of the plugs into the ports, wherein the three or more apertures are spaced apart from each other corresponding to a spacing of the ports for the networking device.

2. The cable bundle according to claim 1, wherein the slider can be moved along the axis of the cable bundle.

3. The cable bundle according to claim 1, wherein the position of the slider along the length of the plurality of cables determines the operational length of the three or more non-integrated cables, the operational length being the length of each cable from the tip of a plug connected to it to the point at which the slider meets that cable.

4. The cable bundle according to claim 1, wherein the position of the slider along the length of the three or more non-integrated cables determines flexibility of the three or more non-integrated cables.

5. The cable bundle according to claim 1, wherein the three or more non-integrated cables comprises Ethernet cables.

6. The cable bundle of claim 1, wherein the operational length is a distance from the slider in the position to an end of each plug of the three or more non-integrated cables, wherein the distance prevents incorrect insertion of the plugs into the ports upon insertion of one of the plugs.

7. The cable bundle of claim 1, wherein the three or more non-integrated cables are non-integrated by having separate plugs that do not have connected moldings.

8. A cable bundle holder comprising a slider comprising three or more apertures spaced apart certain distances from each other, each aperture configured to hold one of the three of more non-integrated cables, each cable configured with a separate plug to be inserted into a port, wherein the slider is slidably engaged with the three or more non-integrated cables and movable to a position where the three or more apertures being spaced apart the certain distances from each other allow the plugs for the cables to correspond to distances between the ports such that an operational length of the cables from the at least one slider to each plug maintains the cables in a cable sequence for inserting the plugs for the cables into the ports such that incorrect insertion of plugs into the ports is prevented upon insertion of one of the plugs into one of the ports to prevent incorrect functioning of the networking device due to incorrect insertion of the plugs into the ports, wherein the three or more apertures are spaced apart from each other corresponding to a spacing of ports for the networking device.

9. The cable bundle holder of claim 8, wherein the operational length is a distance from the slider in the position to an end of each plug of the three or more non-integrated cables, wherein the distance prevents incorrect insertion of each plugs into the ports upon insertion of one of the plugs.

10. The cable bundle holder of claim 8, wherein the plugs that do not have connected moldings.

11. The cable bundle holder of claim 8, wherein the slider can be moved along the axis of the cable bundle.

12. The cable bundle according to claim 8, wherein the position of the slider along the length of the three or more non-integrated cables determines operational length of the three or more non-integrated cables, the operational length being the length of each cable from the tip of each plug connected to it to the point at which the slider meets that cable.

13. The cable bundle holder of claim 8, wherein the position of the slider along the length of the plurality of cables determines flexibility of the three or more non-integrated cables.

14. The cable bundle holder of claim 8, wherein the three or more non-integrated cables comprise Ethernet cables.

* * * * *